United States Patent [19]

Roberts et al.

[11] Patent Number: 4,747,785

[45] Date of Patent: May 31, 1988

[54] SHIELDING FOR CONNECTOR HOOD

[75] Inventors: Arthur Roberts, Westbury; Richard Leeds, Lawrence, both of N.Y.

[73] Assignee: Global Equipment Company, Div. of Continental Dynamics

[21] Appl. No.: 944,655

[22] Filed: Mar. 17, 1987

[51] Int. Cl.[4] ..... H01R 13/658

[52] U.S. Cl. ..... 439/88; 439/465; 439/610

[58] Field of Search ..... 339/143 R, 103 B, 103 L, 339/103 M, 107, DIG. 3; 439/607-610, 449, 460, 465, 906, 927, 86-91

[56] References Cited

U.S. PATENT DOCUMENTS

| | | | |
|---|---|---|---|
| 3,344,393 | 9/1967 | Hendee | 339/107 |
| 4,449,774 | 5/1984 | Takashi et al. | 339/DIG. 3 |
| 4,449,778 | 5/1984 | Lane | 339/143 R |
| 4,536,045 | 8/1985 | Reichardt et al. | 339/143 R |
| 4,537,458 | 8/1985 | Worth | 339/143 R |
| 4,619,487 | 10/1986 | Brush, Jr. | 339/143 R |

*Primary Examiner*—John McQuade
*Attorney, Agent, or Firm*—Thomas R. Morrison

[57] ABSTRACT

Two conductive mating halves of a connector hood include facing inserts of resilient conductive materials. A cable, having shielding conductive braid or foil exposed on a surface thereof is contacted in passing between the inserts. A low-resistance electrical path is provided between the shielding and the conductive connector hood by a resilient conductive material for resisting escape of radio-frequency interference from the connector hood. In one embodiment of the invention, a foam material with parallel embedded metallic wires is employed for the resilient conductive material. The wires are preferably oriented for conduction between the connector hood and the shield braid or foil on the cable with substantially no conductive paths parallel to the axis of the cable. Facing, metallic spring-type strain-relief devices in the connector hood provide strain relief as well as enhance the resistance to radiation of radio-frequency interference.

9 Claims, 3 Drawing Sheets

SHIELDING FOR CONNECTOR HOOD

BACKGROUND OF THE INVENTION

The present invention relates to electrical connectors and, more particularly, to techniques for shielding electrical connectors for preventing leakage of radio frequencies therefrom.

Low-resistance electrical continuity in electrical shields has long been a recognized requirement for preventing leakage of radio-frequency interference (RFI) capable of disrupting the performance of external electronic equipment. Cables are frequently shielded with metallic braid and/or metallic foil forming a cylinder about signal-carrying conductors. Openings in the braid are kept small enough that they are substantially continuous at the frequencies of interest.

A recognized problem in maintaining shielding integrity is found in connectors for connecting the signals on the cables to other equipment or other cables. One type of connector provides an interface between a shielded cable and the pins or holes of a mating connector. The shielding braid or foil on the cable is conventionally trimmed short of the point at which connection with the wires is made in the connector. If no provision is made to prevent it, RFI may escape from the unshielded exposed wires within the connector.

U S. Pat. Nos. 3,322,885 and 3,375,483 disclose a conductive plastic material cast in a connector contacting the cable shield and the interior of the metallic casing or hood of the connector for producing electrical continuity therebetween. Although this technique may be effective for providing electrical shielding continuity between the braid or foil on the conductors and the connector casing, it fails to lend itself to assembly by an unsophisticated consumer. In addition, even in a commercial cable assembly application, the requirement for one or two plastic casting operations makes such techniques too complicated compared to available alternatives.

U.S. Pat. No. 3,424,853 discloses a mesh gasket ring, U.S. Pat. No. 3,739,076 discloses a coil spring in the form of a ring, and U.S. Pat. No. 3,830,957 discloses a resilient ring covered with a braid. All of these patents are adapted to maintaining shielding integrity in a cylindrical connector. The conductive element is compressed into circular contact with the shield braid or other cylindrical object by an annular beveled surface. None of these disclosures appear relevant to providing shielding integrity in flat connectors of common use in connecting computer equipment and peripherals.

In U.S. Pat. No. 4,575,174, of common assignee with the present invention, an electrical connector hood is disclosed having an integral strain relief. A strain relief tab, integrally formed with each half of the hood extends toward the cable passing therebetween to transfer forces from the cable to the hood without permitting such forces to reach soldered connections in the connector. This invention is concerned with strain relief and not with shielding continuity. Indeed, the preferred embodiment of the invention is plastic. Shield braid on a cable is neither illustrated nor described.

Communication between computer equipment and peripherals conventionally employ serial or parallel data transfer on shielded cables. Parallel data cables conventionally employ 50-pin connectors. Serial data cables may employ from as few as two to as many as 50 or more conductors connected to a male or female connector. Common serial connectors are identified by the maximum number of conductors they are capable of handling. For example, a DB-9 connector is capable of connecting up to 9 conductors. A DB-25 connector is capable of connecting up to 25 conductors. Due to the wide distribution and use of DB-25 connectors, such a 25-pin connector is chosen for the following description. It will be understood that other connectors fall within the scope of the invention.

A shielding DB-25 connector includes a connector and a hood consisting of mating halves formed of metal or plastic with a conductive coating on a surface thereof. The shield braid or foil is trimmed back from the bared ends of the conductors. The conductors are soldered to appropriate ones of the pins or sockets in the connector. The two halves of the hood are then assembled over the connector and cable end with the cable passing out through an opening formed between the two halves of the hood.

DB-25 connectors are employed for connecting from as few as one or two, to as many as 25, shielded conductors to an equipment or to another cable. The diameter of a cable containing one or two conductors is substantially different from the diameter of a cable containing 25 conductors. In the prior art, the effective diameter of the opening in the hood is varied for different cable diameters in order to achieve both strain relief and electrical continuity between the cable shield and the hood. The variation in effective diameter is conventionally achieved by one of the following techniques: different hood models each having a different entry diameter, each hood shipped with several resilient grommets having outside dimensions fitting an enlarged opening in the hood and varying inside dimensions each suitable for a small range of cable diameters, and a cable clamp adjustable by screw or ratchet to clasp the cable.

In the prior-art technique employing different opening diameters, the shield is compressed between the halves of the hood for attaining electrical continuity therebetween. This technique has the disadvantage that a cable assembler must carry a number of different hood models in stock in order to accommodate any number of conductors in the cable.

In the prior-art technique employing grommet adapters, four or five grommet sizes are provided with each hood, of which only one is used. The remainder are scrap. This represents a substantial waste of resources. In addition, the grommet must be slipped onto the cable before affixing the conductors to the connector. If it is later discovered that the wrong size of grommet was chosen, the partially assembled connector must be either discarded or disassembled. Further, in order to attain electrical continuity, the shield braid or foil must be folded back along the outside of the grommet before the halves of the hood are assembled thereon. It has been found very difficult to perform this folding, particularly for shield braid. The difficulty is found to be particularly severe in a custom cable assembly operation where an operator is expected to assemble many cables in a working day.

Finally, the clamping techniques of the prior art have not addressed the RFI problem. Generally, when clamping a cable having a small number of conductors, a substantial opening exists between a clamping member and the opening in the hood. RFI may propagate through such an opening.

OBJECTS AND SUMMARY OF THE INVENTION

It is an object of the invention to provide an improved technique for attaining shielding integrity between a shielded cable and an electrically conducting housing or hood of a connector.

It is a further object of the invention to provide a connector hood having apparatus for improving electrical continuity between the connector hood and a shield of a shielded cable.

It is a still further object of the invention to provide a connector hood having an elastomeric RFI shield at an opening thereof.

It is a still further object of the invention to provide a connector hood having a resilient strain relief tab therein.

It is a still further object of the invention to provide a connector hood having an elastomeric RFI shield at an opening thereof. The elastomeric RFI shield includes oriented conductors between the cable shield and the hood without conductors parallel to the axis of the opening.

Briefly stated, the present invention provides two conductive mating halves of a connector hood having facing inserts of resilient conductive materials. A cable, having shielding conductive braid or foil exposed on a surface thereof, is contacted in passing between the inserts. A low-resistance electrical path is provided between the shielding and the conductive connector hood by a resilient conductive material for resisting escape of radio-frequency interference from the connector hood. In one embodiment of the invention, a foam material with parallel embedded metallic wires is employed for the resilient conductive material. The wires are preferably oriented for conduction between the connector hood and the shield braid or foil on the cable with substantially no conductive paths parallel to the axis of the cable. Facing metallic spring-type strain-relief devices in the connector hood provide strain relief as well as enhance the resistance to radiation of radio-frequency interference.

According to an embodiment of the invention, there is provided apparatus for providing electrical continuity between a connector hood and a shield on a cable attachable to a connector associated with the connector hood, the connector hood including at least one conductive surface thereon, comprising: the connector hood including first and second half hoods, each of the first and second half hoods including cooperating means together forming an opening for the entry of the cable and the shield into the connector hood, first and second masses of a resilient conductive material, each of the first and second half hoods including means for positioning the first and second masses respectively facing each other within the connector hood adjacent the opening, the shield being exposed over at least a portion thereof passing between the first and second masses, a dimension and a resilience of the first and second masses being effective for urging facing surfaces thereof into contact with the shield and further being effective for urging the facing surfaces into contact with each other over substantially all portions thereof not contacting the shield, and the first and second masses of a resilient conductive material contacting the at least one conductive surface, whereby electrical continuity between the shield and the at least one conductive surface is achieved.

According to a feature of the invention, there is provided apparatus for providing electrical continuity between a connector hood and a shield on a cable attachable to a connector associated with the connector hood, the connector hood including at least one conductive surface thereon, comprising: the connector hood including first and second half hoods, each of the first and second half hoods including cooperating means together forming an opening for the entry of the cable and the shield into the connector hood, a strain relief in at least one of the first and second half hoods, the conductive strain relief including means for electrical conduction with the at least one conductive surface, a strain relief tab on the conductive strain relief, and resilient means for biasing the strain relief tab into contact with the cable.

According to a further feature of the invention, there is provided a connector and connector hood comprising: the connector hood including first and second half hoods matable together to form the connector hood, means in the connector hood for securing the connector therein, each of the first and second half hoods including cooperating means together forming an opening for the entry of a shielded cable therein, the shielded cable including a shield, at least first and second portions of the first and second half hoods, respectively, having conductive surfaces thereon, first and second masses of a resilient conductive material, each of the first and second half hoods including means for positioning the first and second masses respectively facing each other within the connector hood adjacent the opening, the shield being exposed over at least a portion thereof passing between the first and second masses, a dimension and a resilience of the first and second masses being effective for urging facing surfaces thereof into contact with the shield and further being effective for urging the facing surfaces into contact with each other over substantially all portions thereof not contacting the shield, and the first and second masses of resilient material contacting the at least one conductive surface, whereby electrical continuity between the shield and the at least one conductive surface is achieved.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
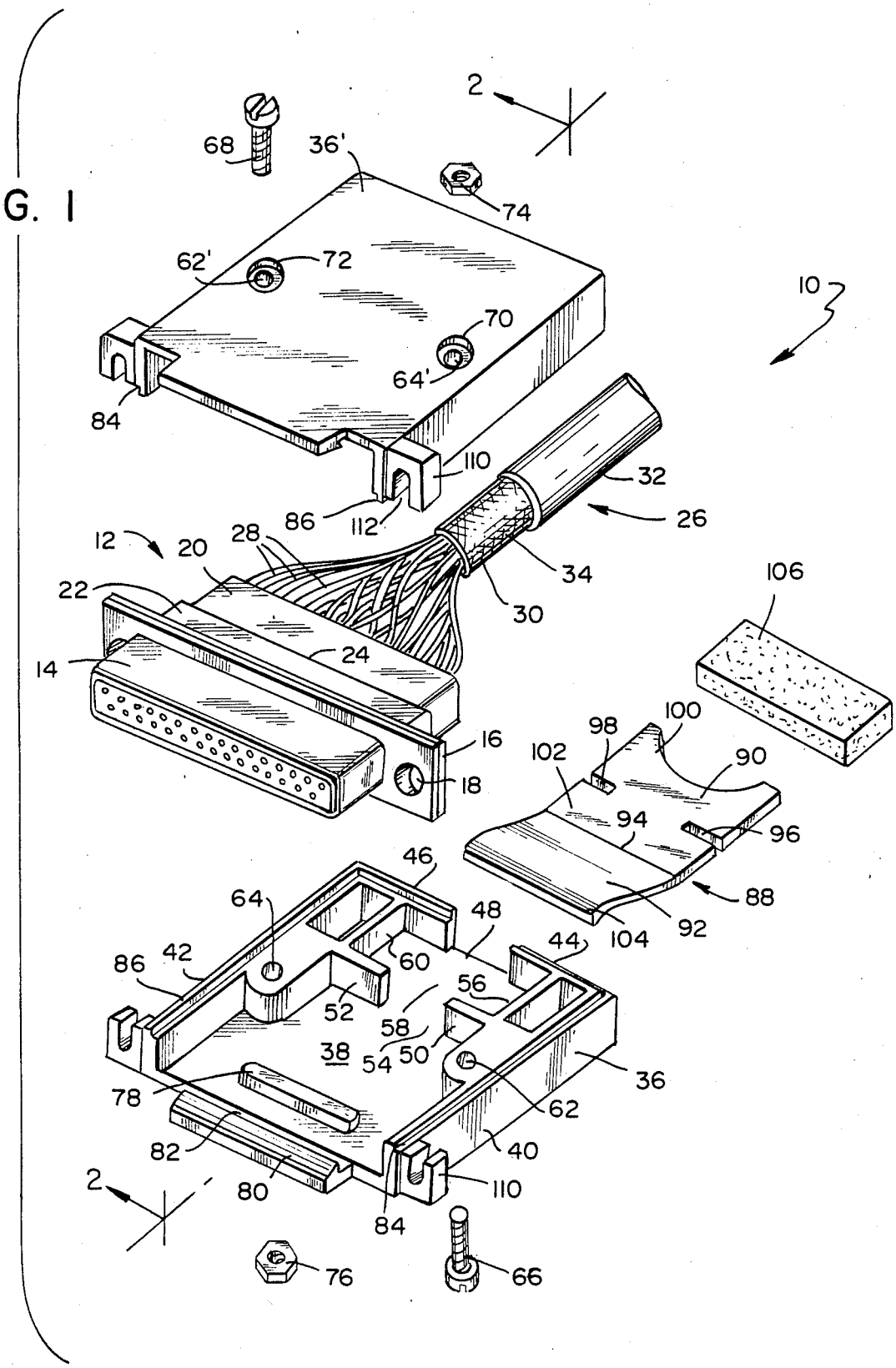
FIG. 1 is a perspective exploded view of an RFI shielded connector assembly according to an embodiment of the invention.

Referring now to FIG. 1, there is shown, generally at 10, an RFI shielded connector assembly according to an embodiment of the invention. The present invention is equally applicable to male and female connectors. A female connector 12 is selected for purposes of description.

Connector 12 includes a metallic housing 14 including a flange 16 extending outward from a central portion thereof. Flange 16 conventionally includes holes 18 therein for affixing RFI shielded connector assembly 10 to a mating connector (not shown). An insulating block 20 enters an inner portion 22 of metallic housing 14. A step 24 is formed at the location where insulating block 20 enters inner portion 22. Advantage will be taken of step 24 in the securing of metallic housing 14 within RFI shielded connector assembly 10 as will be detailed hereinafter.

A shielded cable 26 includes a plurality of wires 28, each conventionally encased in an insulating coating (not shown separately). A shielding layer 30 covers wires 28 within shielded cable 26, but is trimmed back to permit wires 28 to be spread out and connected to terminals (not shown) in the rear of insulating block 20 by any convenient means such as, for example, soldering. An insulating cable sheath 32, formed over shielding layer 30, is preferably trimmed back to form a substantial exposed length 34 for purposes which will be explained. First and second hood halves 36 and 36', preferably identical, are disposed, one on either side of connector 12. Since hood halves 36 and 36' are in the following paragraphs. In a later part of the disclosure, the cooperation between hood half 36, hood half 36', and connector 12 is described.

Hood half 36 includes a wall 38 having first and second side walls 40 and 42 at lateral extremities thereof. Rear walls 44 and 46 extend part way toward each other from side walls 40 and 42, respectively, leaving an opening 48 between facing extremities thereof. First and second intermediate walls 50 and 52 extend toward each other from side walls 40 and 42, respectively, also leaving an opening 54 between facing extremities thereof. A first longitudinal web 56 extends between rear wall 44 and intermediate wall 50 to define one end of a pocket 58. A second longitudinal web 60 extends between rear wall 46 and intermediate wall 52 to define a second end of pocket 58. First and second screw holes 62 and 64 provide passage for screws 66 and 68, respectively, therethrough. Countersunk holes 70 and 72 (illustrated in hood half 36' but also existing in hood half 36) are aligned with scew holes 64' and 62', respectively. Countersunk holes 72 preferably have a cylindrical cross section for accommodating a head of screws 68 and 66, respectively, whereas, countersunk holes 70 have a hexagonal cross section for accommodating a hexagonal shape of nuts 74 and 76.

A boss 78 extends across wall 38 parallel to a lip 80. A groove 82 is disposed at the junction of lip 80 with wall 38. A peripheral depression 84 extends about the edges of side wall 40 and rear wall 44. A peripheral ridge 86 extends about the edges of side wall 42 and rear wall 46. When hood halves 36 and 36' are assembled in facing abutment as shown, peripheral ridge 86 on hood half 36 engages peripheral depression 84 on hood half 36' and vice versa. Besides providing stability of fit between the mating elements, this interfitting of peripheral depression 84 and peripheral ridge 86 improves RFI containment in connector 12.

A strain-relief spring 88 includes a generally planar portion 90 joined to a strain relief tab 92 at an obtuse-angled bend 94. Planar portion 90 includes first and second notches 96 and 98 dividing it into an end portion 100 and an intermediate portion 102. Notches 96 and 98 are sized to engage intermediate walls 50 and 52, respectively, with end portion 100 disposed in pocket 58 and intermediate portion 102 disposed on the other side of intermediate walls 50 and 52. Strain relief tab 92 optionally includes a turned lip 104 at an extremity thereof.

A resilient conductive pad 106, preferably parallepiped in shape, is slightly oversize for fitting within pocket 58. By compressing resilient conductive pad 106 slightly, it is fittable into pocket 58 atop end portion 100. The resilience of resilient conductive pad 106 then is capable of retaining itself, as well as end portion 100, in the partly assembled condition while other assembly operations are performed. A strain-relief spring 88 and a resilient conductive pad 106, identical to those employed in hood half 36, are also provided for hood half 36', but are not shown.

As used herein, the terms resilient and resilience are intended to connote yielding properties with at least some shape memory. The term pliable, among others, could be substituted for resilient without departing from the scope of the invention. The yielding properties permit the material to deform into conformity with a surface. The shape memory permits the material to remain urged into intimate contact with the surface after the initial deformation is completed.

Figure 2:
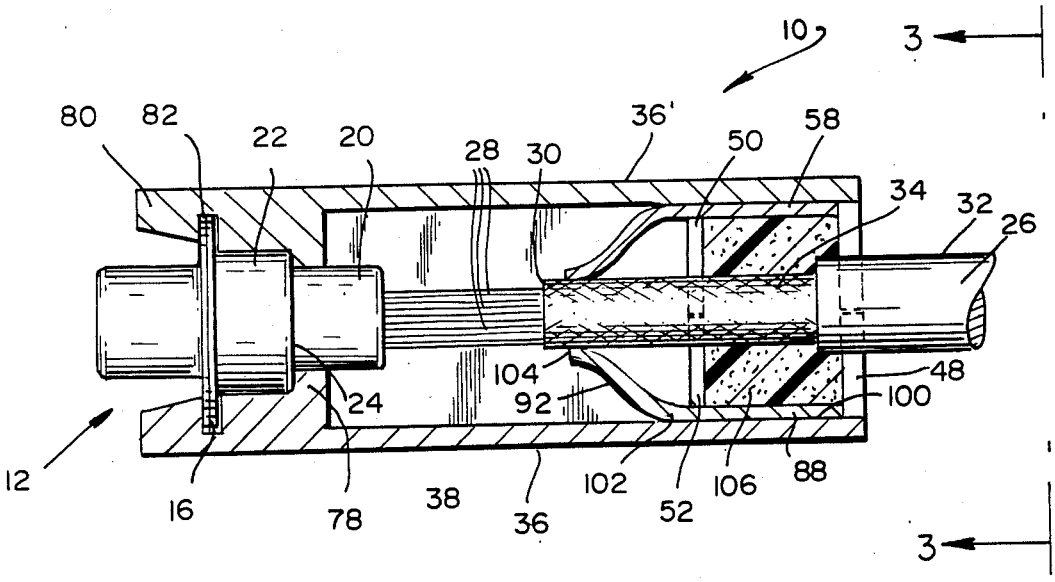
FIG. 2 is a cross section taken along II—II in FIG. 1.

Referring now also to FIG. 2, during assembly of RFI shielded connector assembly 10, shielded cable 26 compresses the facing surfaces of the two resilient conductive pads 106 as necessary to accommodate the diameter of shielded cable 26. Ohmic contact between resilient conductive pads 106 and exposed length 34 of shielding layer 30 provides electrical continuity between shielding layer 30 and hood halves 36 and 36'. The resilience of resilient conductive pads 106 permits them to fit tightly about exposed length 34 and to abut each other along a line of contact beyond shielded cable 26. Thus, substantially the entire volume of pocket 58 in each hood half 36 is occupied by electrically conductive material and by shielded cable 26 with electrical continuity between the conductive material and shielding layer 30.

Figure 3:
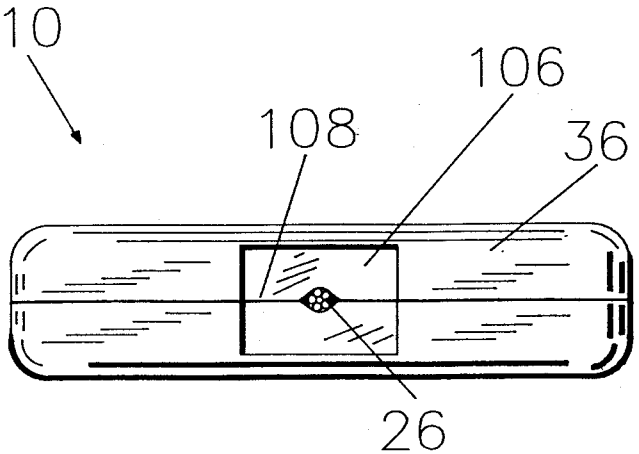
FIG. 3 is a view taken in a direction III—III in FIG. 2 wherein a small-diameter cable is accommodated.

Referring now to FIG. 3, an end view of RFI shielded connector assembly 10 is illustrated with a small-diameter insulating shielded cable 26. Since the two resilient conductive pads 106 are slightly oversize for their respective pockets 58 (not shown in FIG. 3), their surfaces are urged into ohmic contact at a line of contact 108 therebetween. Their resilience permits them to conform to the surface of shielded cable 26, including at a point adjacent to line of contact 108.

Figure 4:
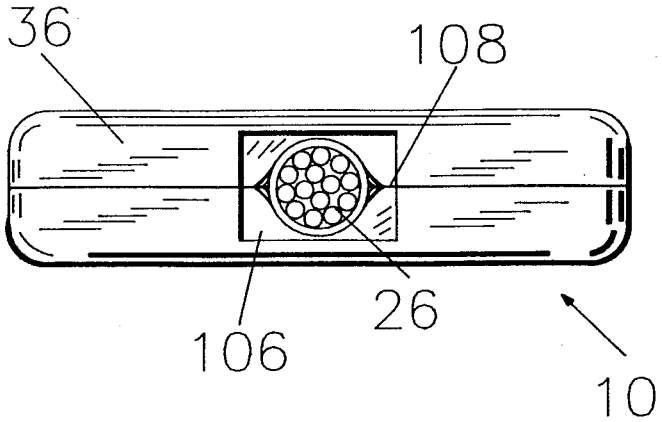
FIG. 4 is a view taken in the direction III—III in FIG. 2 wherein a large-diameter cable is accommodated.

Referring now to FIG. 4, a larger-diameter shielded cable 26 is accommodated in the same manner as the smaller-diameter shielded cable 26 of FIG. 3 without requiring different models of RFI shielded connector assembly 10 or a plurality of grommets or other fitting, some of which are discarded after one is selected for assembly.

Any suitable material may be chosen for resilient conductive pad 106 provided it has the desired ability to conform closely to the shape of shielded cable 26 and has a low resistivity in a direction normal to an axis of shielded cable 26. One suitable material is disclosed in U.S. Pat. No. 4,449,774 wherein a resilient plastic material includes thin embedded wires disposed in a unidirectional array between parallel surfaces. For present purposes, the direction of orientation of the embedded wires is chosen to be normal to line of contact 108, whereby low-resistance electrical contact is attained between exposed length 34 on shielded cable 26 and hood half 36 (and hood half 36') with high resistance exhibited in other directions. Some types of resilient plastic foam with embedded conductors include conductors passing in two orthogonal directions with high resistance in the third orthogonal direction. Such material may be employed in resilient conductive pad 106 if the high-resistance axis is chosen parallel to the axis of shielded cable 26.

In one type of low-resistance foam, generally parallel fine-gauge Monel metal wires extend from one surface to the other. When the foam is compressed, the ends of the wires extend outward from the foam in a manner similar to the extension of the claws of a cat. The ends of the wires, extending slightly beyond the surface of the foam, tend to penetrate contaminants on the surface of shielding layer 30 for improved conductivity therebetween. It is believed that limiting the conductive axes of resilient conductive pad 106 to exclude a direction terminating in the outside-facing surface of resilient conductive pad 106 tends to reduce the propagation of radiation external to RFI shielded connector assembly 10.

Other materials may be employed in resilient conductive pad 106 besides oriented, wire-loaded, plastic foam. For example, a foam gasket material having a woven metallic cover may be suitable for substitution in resilient conductive pad 106. In such a device, high-frequency currents are confined to inner surfaces of the metallic cover and the amplitude of external radiation is very small. Such material is available under the trademark Tecknit Strips at the time of filing of the present application from commercial vendors such as, for example, the Tecknit Company. Other shielding materials such as, for example, Mesh Strip sold by Chomerics Company, employing wire mesh tubes with or without a resilient core, may be substituted without departing from the spirit and scope of the invention.

Referring again to FIGS. 1 and 2, it has been discovered that, in addition to the RFI reduction attained by the inclusion of resilient conductive pads 106 in RFI shielded connector assembly 10, additional RFI reduction is produced by the presence of strain-relief springs 88. Indeed, it has been discovered that metallic embodiments of strain-relief springs 88, even in the absence of resilient conductive pads 106, when assembled in contact with shielding layer 30, produce an RFI attenuation equal to, or superior to, some of the devices of the prior art over certain bands of frequencies. When strain-relief springs 88 and resilient conductive pads 106 are used in combination, an additional increment of RFI attenuation of about 30 decibels is attained over some frequency ranges. Thus, resilient conductive pads 106 and strain-relief springs 88 may be considered to be independent inventions, and the combination of the two may be considered to be a third invention.

Besides the novel features of the invention illustrated and described in the preceding, RFI shielded connector assembly 10 may include additional conventional elements. For example, each hood half 36 may include a pair of lugs 110 adjacent flange 16. A pair of adjacent lugs 110 from each hood half 36 having facing notches 112 forming an opening for a screw (not shown) passing therethrough and through hole 18 for attachment to a mating connector. One advantage of such an arrangement is found in the possibility of improved electrical continuity between RFI shielded connector assembly 10 and the mating connector. Such lugs 110 may be omitted without departing from the spirit and scope of the invention.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. Apparatus for providing electrical continuity between a connector hood and a shield on a cable attachable to a connector associated with said connector hook, said connector hood including at least one conductive surface thereon, comprising:

a connector hood;

said connector hood including first and second half hoods;

each of said first and second half hoods including cooperating means together forming an opening for the entry of said cable and said shield into said connector hood;

first and second masses of a resilient conductive material;

each of said first and second half hoods including means for positioning said first and second masses respectively facing each other within said conector hood adjacent said opening;

said shield, when said cable is installed in said hood, being exposed over at least a portion thereof passing between said first and second masses;

a dimension and a resilience of said first and second masses being effective for urging facing surfaces thereof into contact with said shield and further being effective for urging said facing surfaces into contact with each other over substantially all portions thereof not contacting said shield; and said first and second masses of a resilient conductive material contacting said at least one conductive surface, whereby electrical continuity between said shield and said at least one conductive surface is achieved.

2. Apparatus according to claim 1 wherein said resilient conductive material includes at least one axis of conduction.

3. Apparatus according to claim 2 wherein said resilient conductive material has a single axis of conduction, said single axis of conduction being disposed for conduction normal to an axis of said cable.

4. Apparatus according to claim 2 wherein a direction of said at least one axis of conduction substantially excludes conduction to a surface of said resilient conductive material exposed to an exterior of said connector hood.

5. Apparatus according to claim 1 wherein said resilient conductive material includes a resilient plastic having a plurality of oriented conductors embedded therein.

6. Apparatus according to claim 1 wherein:

each of said means for positioning includes a pocket adjacent said opening;

each of said masses of resilient material being substantially oversize for fitting into its respective pocket whereby said mass of resilient material is compressed for fitting into said pocket; and said resilience being effective for retaining said mass of resilient material when said mass of resilient material is compressed in said pocket.

7. Apparatus according to claim 1, further a conductive strain relief in at least one of said first and second half hoods;

said conductive strain relief including means for electrical conduction with said at least one conductive surface;

a strain relief tab on said conductive strain relief; and resilient means for biasing said strain relief tab into contact with said cable.

8. Apparatus according to claim 7 wherein:

said at least one conductive surface includes at least a surface beneath at least one of said masses of resilient conductive material;

said means for electrical conduction includes a portion contacting said at least one conductive surface beneath said at least one mass of conductive material; and said at least one mass of conductive material contacting said portion, whereby conduction from said at least one mass of resilient conductive to said at least one conductive surface is at least partly through said strain relief.

9. Apparatus comprising:

a connector;

a connector hood;

said connector hood including first and second half hoods matable together to form said connector hood;

means in said connector hood for securing said connector therein;

each of said first and second half hoods including cooperating means together forming an opening for the entry of a shielded cable therein;

said shielded cable including a shield;

at least first and second portions of said first and second half hoods, respectively, having conductive surfaces thereon;

first and second masses of a resilient conductive material;

each of said first and second half hoods including means for positioning said first and second masses respectively facing each other within said connector hood adjacent said opening;

said shield, when said cable is installed in said hood, being exposed over at least a portion thereof passing between said first and second masses;

a dimension and a resilience of said first and second masses being effective for urging facing surfaces thereof into contact with said shield and further being effective for urging said facing surfaces into contact with each other over substantially all portions thereof not contacting said shield; and said first and second masses of resilient material contacting said at least one conductive surface, whereby electrical continuity between said shield and said at least one conductive surface is achieved.

* * * * *